United States Patent [19]

Kamperman

[11] 3,945,865

[45] Mar. 23, 1976

[54] METAL DISSOLUTION PROCESS

[75] Inventor: David Robert Kamperman, Harmony, Pa.

[73] Assignee: Dart Environment and Services Company, Los Angeles, Calif.

[22] Filed: July 22, 1974

[21] Appl. No.: 490,456

[52] U.S. Cl. ..... 156/18; 156/19; 252/79.2; 252/79.4

[51] Int. Cl.[2] ..... C23F 1/00; C09K 13/04

[58] Field of Search ..... 156/18, 20; 252/79.2, 79.4; 134/3

[56] References Cited

UNITED STATES PATENTS

| | | | |
|---|---|---|---|
| 2,154,451 | 4/1939 | Hull | 252/79.2 |
| 3,293,093 | 12/1966 | Jones et al. | 252/79.4 |
| 3,537,895 | 12/1970 | Lancy | 134/3 |
| 3,556,883 | 1/1971 | Maita et al. | 252/79.4 |
| 3,673,094 | 6/1972 | Kremi | 252/79.4 |
| 3,801,512 | 4/1974 | Solenberger | 252/79.4 |

*Primary Examiner*—Douglas J. Drummond
*Assistant Examiner*—Jerome W. Massie
*Attorney, Agent, or Firm*—Fred S. Valles; Margareta LeMaire

[57] ABSTRACT

Evolution of NOx fumes during dissolution of metal values in mineral acid solutions of nitric acid can be eliminated by the addition of small quantities of hydrogen peroxide to the acid solution.

13 Claims, No Drawings

METAL DISSOLUTION PROCESS

Nitric acid is a powerful and useful oxidizing agent which is frequently employed in the dissolution and etching of metals, as very few metallic elements and alloys are resistant to its oxidative attack. However, the attack on metals generally involves the reduction of nitrogen and results in the production of oxides of nitrogen which can create a serious air pollution problem. The oxides of nitrogen most commonly present in the gaseous effluents from a nitric acid oxidizing system are the colorless nitric oxide (NO) and the brown nitrogen dioxide ($NO_2$). Since nitric oxide reacts instantly and almost quantitatively with atmospheric oxygen to produce nitrogen dioxide, these two oxides are generally considered as a single NO*x* toxic pollutant.

The persistent generation of concentrated NOx fumes where relatively concentrated acid solutions containing nitric acid is used as an oxidizing reagent necessitates control to prevent it from becoming an intolerable health hazard. Where control now exists, most commonly the NOx fumes are exhausted from the immediate area of generation, and then subjected to water scrubbing in an attempt to prevent their discharge into the environment. However, the NOx removal by scrubbing is at best marginal.

As shown in the following simplified reaction, the scrubbing of $NO_2$ with water results in the production of nitric acid and nitric oxide.

$$3\ NO_2 + H_2O \rightarrow 2HNO_3 + NO$$

The dilute nitric acid produced has little or no value and creates and additional waste treatment problem. The nitric oxide produced by this process, and any nitric oxide initially present in the exhaust fumes, passes through the scrubber and exits free to combine with atmospheric oxygen to again form the brown, toxic nitrogen dioxide. Recycling the effluent becomes an endless, impractical process of limited effectiveness. Although other more expensive and exotic systems find their most feasible application in the area of nitric acid manufacturing and fuel-burning processes where the need to eliminate many millions of tons of potential NOx pollutants justifies their expense.

It is known in the prior art to employ acidified hydrogen peroxide solutions as a pickle for metals such as copper and copper alloys. The pickle solutions, which contain a relatively high mole ratio of hydrogen peroxide to acid, are generally mildly acidic containing from about 5 to about 15 percent of a mineral acid. The latter usually is sulfuric acid, but other mineral acids such as nitric, hydrochloric and hydrofluoric acids have also been suggested. (U.S. Pat. No. 3,649,194). However, prior to this invention nitric acid-hydrogen peroxide systems have never been in commerical use. The addition of hydrogen peroxide to such acid solutions therefore had no other intended effect than to improve the pickling rate.

The present invention relates to a method or process by which the complete elimination of any effluent oxides of nitrogen can be achieved in systems where a mineral acid solution containing nitric acid is used for the dissolution of metal values. Included within the definition of the above mentioned systems are those employed in etching, pickling, bright dipping, stripping of metallic coatings and the like.

It has been found that the presence of hydrogen peroxide prevents the evolution of oxides of nitrogen where oxidative metal dissolution occurs. This additional oxidant may function either to re-oxidize any NOx species produced by oxidation-reduction reactions, or it may serve to assist the nitric acid in the oxidizing function so that no NOx compounds are formed during metal dissolution. In either event, the presence of such an additive eliminates NOx emissions; and thereby, negates the need for any type of NOx control device and permits the employment of nitric acid systems without endangerment to the endangerment to the environment.

As hydrogen peroxide performs its oxidative function, it is itself converted to oxygen and water. The generation of NO*x* fumes, so common to nitric acid systems, is thereby replaced by a mild evolution of oxygen, and the water produced has only a small dilution effect upon the process solution.

The addition of hydrogen peroxide to solutions of almost any practical concentration of nitric acid has been found to completely stop the effluent of oxides of nitrogen generated by metal dissolution processes. This also applies to mixed mineral acid systems where one or more acids are used in conjunction with nitric acid for the dissolution of metal values.

In all cases, neither visual nor spectral measurements made on these systems detected the presence of any effluent oxides of nitrogen as long as the concentration of hydrogen peroxide in the working solution was maintained above 1 gram per liter. If the hydrogen peroxide concentration was permitted to drop below this minimum value, then the presence of NOx effluents was immediately in evidence. The upper limit of hydrogen peroxide is set only by the consideration of what concentration is desirable and practical to be maintained in a given application. Experience shows that a preferred maximum concentration for hydrogen peroxide is 30 grams per liter. Operation in the range of 5–20 grams per liter usually provides a sufficient safeguard against production of NO*x* fumes due to sudden hydrogen peroxide consumption, without maintenance of a superfluous amount of this reagent in the process solution.

It was noted in the experimental work that the suppression of NOx fumes by hydrogen peroxide showed no tendency to be a temperature dependent phenomenon. Various simulated process solutions containing nitric acid were observed in the course of this work over a temperature range of 10° to 70° Centigrade, and in all cases, this method was found to be effective. The optimum conditions of temperature will naturally vary from one application to another, depending upon what metal or metals are to be attacked and the rate of dissolution desired. For most applications the preferred temperature range of from about 20° to about 55°C will be appropriate.

In some systems the stability of hydrogen peroxide is adversely affected by the presence of certain metals, such as iron, copper and lead, which catalyze its autodecomposition. In systems where this problem occurs, it can be attenuated by addition of suitable reagents known in the art to stabilize hydrogen peroxide in these circumstances, such as organic compounds that carry polar hydrogen atoms, for example compounds containing carboxyl or hydroxyl groups. Included in this group are the fatty acid, glycerine and glycol stabilizers disclosed in U.S. Pat. No. 3,537,895, the disclosure being incorporated in this specification by reference. Specific examples of other such stabilizers are allyl alcohol, crotyl alcohol, cis-1,4-but-ene-diol, and phenolic compounds such as phenol, p-phenol sulfonic acid or simple salts thereof, and p-methoxy phenol. The particular selection of stabilizer used is not important to the invention of the present application.

The concentration of hydrogen peroxide may be kept in the desired range by appropriate additions to compensate for the consumption. The actual concentration can be monitored either by manual titrations or automated means known in the art.

One application in which the present invention is particularly advantageous is in the bright dipping of copper and copper alloys. Commonly aqueous solutions of nitric acid and sulfuric acid with a small quantity of hydrochloric acid are used for the bright dipping of these metals, a typical formulation[1] being as follows:

| Ingredients: | | Volume | Gms/l |
|---|---|---|---|
| $H_2SO_4$ | (96%) | 2 Gallons | 785 |
| $HNO_3$ | (67%) | 1 Gallon | 210 |
| HCl | (37%) | ½ Fluid Ounce | 0.4 |
| $H_2O$ | | 1.5 Gallons | — |

[1] "Metal Finishing Guidebook and Directory", 1974, 42nd Edition, Metals and Plastics Publications, Inc., p. 226.

It was surprisingly found that the acid concentration requirements could be drastically reduced in bright dip solutions containing hydrogen peroxide. The bright dip solutions of this invention produce no NOx fumes and yield a clean bright surface on copper and copper alloys comparable to or better than those of the conventional systems. Listed below are the broad and preferred ranges of the ingredients of the bright dip solutions of the present invention.

| Ingredients | Broad Range gms/l | Preferred Range gms/l |
|---|---|---|
| $H_2SO_4$ | 200–600 | 430–460 |
| $HNO_3$ | 75–200 | 100–150 |
| HCl | 0.1–5 | 0.2–3 |
| $H_2O_2$ | 1–30 | 8–12 |

Preferably, a hydrogen peroxide stabilizer is added to the bright dip solution to prevent or reduce the catalytic decomposition of hydrogen peroxide.

It is also preferred to add a surface passivation agent to the bright dip solution in order to prevent staining or tarnishing of the metal surface, sometimes occurring during the time lag between the bright dipping and the first rinse.

Many chemical compounds well known in the art are suitable as surface passivation agents, e.g. organic nitrogen compounds such as amines and imines. Specific examples include the aliphatic amines, cyclo-alkyl amines, N,N'-dialkyl aniline and benzotriazol of U.S. Pat. No. 3,773,557, hereby incorporated in the disclosure by reference. Other suitable agents include the chelating agents disclosed in the aforementioned U.S. Pat. No. 3,537,895.

For a better understanding of the invention, the following examples are provided and are not intended to be limiting.

EXAMPLE I

The experiment was carried out to demonstrate the effectiveness of the invention when dissolving copper in a strong nitric acid solution. A copper panel weighing 52.86 grams was immersed in 0.3 liter of an aqueous solution containing 700 grams per liter nitric acid, approximately 18.9 grams per liter of $H_2O_2$ and 22.2 grams per liter of ethylene glycol, the solution having a temperature 23°C. After a short period of time, the panel was removed, rinsed, dried and weighed (49.56 grams). The final hydrogen peroxide concentration was determined (8.35 grams per liter) and from this a hydrogen peroxide consumption of about 1.8 moles $H_2O_2$/mole copper dissolved could be calculated. No evolution of NOx fumes was detected during the experiment. Similar experiments carried out at 15°, 30°, 35° and 40°C showed hydrogen peroxide consumptions in the range of 1.5–2.1 moles $H_2O_2$/mole of Cu dissolved.

EXAMPLE II

Solutions containing approximately 250 grams per liter nitric acid are known to be employed in the etching of zinc plates used in typographical processes. It is also known that etching of these zinc plates produces a serious localized NOx emission problem. To demonstrate the value of hydrogen peroxide additions in the elimination of NO*x* fuming in this process, the dissolution of weighed portions of metallic zinc were conducted at 10°, 15°, 20°, 25°, 30° and 40° Centrigrade in 0.5 liter of a solution of 250 grams per liter nitric acid and approximately 10 grams per liter hydrogen peroxide. No stabilizer was added. In every case, the complete absence of NO*x* fuming was evident. The average consumption of hydrogen peroxide per mole of zinc dissolved was found to be 0.23 mole. The pertinent data are shown below:

| $H_2O_2$ Initial gms/liter | wt.Zn Initial gms | wt.Zn Final gms | Temperature °C |
|---|---|---|---|
| 10.2 | 148.3437 | 145.8650 | 10 |
| 9.69 | 145.8650 | 142.8504 | 15 |
| 9.10 | 142.8540 | 139.2630 | 20 |
| 8.16 | 139.2630 | 135.3630 | 25 |
| 9.94 | 135.5952 | 131.1552 | 30 |
| 9.01 | 131.7472 | 126.9238 | 40 |

EXAMPLE III

Solutions of nitric and hydrofluoric acid are used in the pickling (removal of metal surface layers) of titanium and zirconium metal and alloys. This process, along with most others that employ nitric acid, is the source of an NOx fuming problem. An experiment was therefore performed to evaluate the effectiveness of hydrogen peroxide additions in the elimination of this source of NOx pollution. A solution containing 114 ml of 70.4 percent nitric acid, 11.4 ml of 43 percent hydrofluoric acid, and 114 ml of water was prepared to simulate a titanium or zirconium pickle solution. Pieces of titanium and zirconium metal were lowered into this solution maintained at about 55°C, and the rapid evolution of brown NO*x* fumes was noted. At the height of NO*x* evolution, hydrogen peroxide was added to the pickle solution (10 grams per liter). An immediate cessation of NOx evolution was observed at this point. Tests on additional pieces of titanium and zirconium showed that the presence of the hydrogen peroxide did not reduce the effectiveness of the nitric-hydrofluoric acid pickle. In fact, test panels pickled in this solution were judged to have a cleaner and brighter surface than those pickled in a solution containing only nitric and hydrofluoric acid.

EXAMPLE IV

The manufacture of tungsten filaments for light bulbs and vacuum tubes requires the use of a nitric-sulfuric acid solution for the dissolution of the molybdenum mandrels on which the tungsten filaments are formed and annealed. Solutions containing 300 grams per liter each of sulfuric and nitric acid and between 2 and 30 grams per liter of hydrogen peroxide were evaluated for use in this process. In all cases, the dissolution of the molybdenum mandrels proceeded smoothly with no apparent attack on the tungsten filament and complete absence of any NO*x* evolution. This process was operated at temperatures between 20° and 70° Centigrade, and in every case, the rate of molybdenum etching was found to be equivalent to or faster than that achieved by a similar solution, without the hydrogen peroxide addition. It was also noted that the dissolution of one mole of molybdenum required the average consumption of 3.88 moles of hydrogen peroxide per mole of molybdenum dissolved.

EXAMPLE V

A solution suitable for bright dipping copper and copper alloys was prepared, which solution contained about 438 grams per liter $H_2SO_4$, 125 grams per liter $HNO_3$, 0.9 grams per liter HCl, 10 grams per liter $H_2O_2$, 22.2 grams per liter ethylene glycol and 7.5 grams per liter of ethylene diamine tetraacetic acid (sodium salt). Samples of hot forged brass were treated at temperatures between 32°–38°C, for 2–3 minutes, allowed to drain for 10–20 seconds and then rinsed. No evolution of NOx fumes were detected and the treated brass exhibited very bright yellow surfaces without any surface staining.

What is claimed is:

1. A method for prevention of evolution of NOx fumes in the dissolution of metal values in mineral acid solutions containing $HNO_3$ which comprises adding hydrogen peroxide to said acid solution, maintaining the hydrogen peroxide concentration during the dissolution at between about 1 and about 20 grams per liter and the mole ratio of hydrogen peroxide to mineral acid at a value of less than 0.273.

2. The method of claim 1 in which the dissolution is carried out at temperatures in the range from about 10° to about 70°C.

3. A process of claim 2 in which said temperatures range from about 20° to about 55°C.

4. A process according to claim 1 wherein a hydrogen-peroxide stabilizer is added to the acid solution.

5. A process according to claim 4 wherein the hydrogen peroxide stabilizer is selected from fatty acids, glycerine, glycols, allyl alcohol, crotyl alcohol, cis-1,4-but-ene-diol, phenol, p-phenol sulfonic acid or salts thereof or p-methoxy phenol.

6. A process according to claim 4 wherein the hydrogen peroxide stabilizer is ethylene glycol.

7. A process according to claim 1 wherein the mineral acid solution is a mixture of nitric acid and at least one acid selected from sulfuric acid, hydrofluoric acid and hydrochloric acid.

8. A process for bright dipping copper or copper alloys without evolution of NO*x* fumes which comprises immersing the copper or copper alloy in a bright dip acid solution containing from about 430 to about 460 grams per liter of $H_2SO_4$, from about 100 to about 150 grams per liter of $HNO_3$ from about 0.2 to about 3 grams per liter of HCl and from about 8 to about 12 grams per liter of hydrogen peroxide.

9. The process of claim 8 wherein the acid solution also contains a hydrogen peroxide stabilizer.

10. The process of claim 8 wherein the acid solution also contains a surface passivation agent.

11. A bright dip solution for copper or copper alloys comprising:

from about 430 to about 460 grams per liter of $H_2SO_4$;

from about 100 to about 150 grams per liter of $HNO_3$;

from about 0.2 to about 3 grams per liter of HCl, and from about 8 to about 12 grams per liter of hydrogen peroxide.

12. The bright dip solution of claim 11 also containing a hydrogen peroxide stabilizer.

13. The bright dip solution of claim 11 also containing a surface passivation agent.

* * * * *